US009888310B2

(12) United States Patent
Nakayama et al.

(10) Patent No.: US 9,888,310 B2
(45) Date of Patent: Feb. 6, 2018

(54) AUDIO EQUIPMENT

(71) Applicant: TEAC Corporation, Tokyo (JP)

(72) Inventors: Mikio Nakayama, Kanagawa-Ken (JP); Takayuki Honda, Tokyo (JP); Kunihiro Oribe, Chiba-ken (JP)

(73) Assignee: TEAC Corporation, Tokyo (JP)

( * ) Notice: Subject to any disclaimer, the term of this patent is extended or adjusted under 35 U.S.C. 154(b) by 0 days.

(21) Appl. No.: 14/874,089

(22) Filed: Oct. 2, 2015

(65) Prior Publication Data

US 2016/0100245 A1 Apr. 7, 2016

(30) Foreign Application Priority Data

Oct. 3, 2014 (JP) ..... 2014-205098

(51) Int. Cl.
*H04R 1/10* (2006.01)
*H04R 5/04* (2006.01)

(52) U.S. Cl.
CPC ..... *H04R 1/1041* (2013.01); *H04R 5/04* (2013.01); *H04R 2420/09* (2013.01)

(58) Field of Classification Search
CPC .. H04R 3/007; H04R 2227/003; H04R 25/43; H04R 27/00; H04R 1/1041; H04R 2420/09; H04R 1/1033; H04R 29/001; H04R 5/033; H04H 20/89; H04M 1/6083; H04M 1/72558; H04N 5/765; H04N 5/907; H04N 9/8042; H04N 9/8047; H04N 21/4143; H04N 21/4627
USPC ..... 381/74, 77, 79, 98, 104–107, 123; 340/4.41
See application file for complete search history.

(56) References Cited

U.S. PATENT DOCUMENTS 4,565,416 A * 1/1986 Rudy ..... H01R 13/4364 439/592
4,578,531 A * 3/1986 Everhart ..... H04L 9/083 380/28
6,172,983 B1 * 1/2001 Shaffer ..... H04L 12/44 370/446
6,492,909 B1 * 12/2002 Washikawa ..... H04B 1/207 340/4.41
7,130,435 B1 * 10/2006 Toda ..... H04B 1/205 348/705
7,224,811 B1 * 5/2007 Narusawa ..... H04L 12/40117 381/119

(Continued)

FOREIGN PATENT DOCUMENTS

JP S64-3374 U 1/1989
JP 11-239289 A 8/1999
JP 2001-086416 A 3/2001

*Primary Examiner* — Lun-See Lao
(74) *Attorney, Agent, or Firm* — Seed Intellectual Property Law Group LLP

(57) ABSTRACT

There is provided audio equipment capable of being miniaturized by sharing a plurality of types of input terminals and output terminals and reducing footprints of the terminals.

The audio equipment has a CPU, ROM, RAM, a USB connector, an SD card, a DAC (D/A converter), a change-over section, an amplifier, a PHONE (headphone) terminal, a DIGITAL I/O LINE-IN terminal, a switch, and a display section. The DIGITAL I/O LINE-IN terminal is a terminal which shares a digital audio optical input terminal, a digital audio coaxial input terminal, a digital audio coaxial output terminal, and an analog audio input terminal. The switch sets the terminal by switching.

4 Claims, 8 Drawing Sheets

(56) References Cited

U.S. PATENT DOCUMENTS

2003/0138112 A1* 7/2003 Doy ..... H03F 3/005
381/74
2016/0099597 A1* 4/2016 Nakayama ..... H02J 7/0052
307/112

* cited by examiner

| Hard Switch \ Soft Switch | | Input/Output | |
|---|---|---|---|
| | | Input | Output |
| Digital IO/ Analog Line In | Digital IO | ○ Optical Input<br>○ Digital Coaxial Input | ○ Digital Coaxial Output |
| | Analog Line In | ○ Line Input | ○ Line Input |

FIG. 8

| Hard Switch \ Soft Switch | | Input/Output | |
|---|---|---|---|
| | | Input | Output |
| Digital IO/ Analog IO | Digital IO | ○ Optical Input<br>○ Digital Coaxial Input | ○ Digital Coaxial Output |
| | Analog IO | ○ Line Input | ○ Line Output |

FIG. 11

AUDIO EQUIPMENT

PRIORITY INFORMATION

This application claims priority to Japanese Patent Application No. 2014-205098 filed on Oct. 3, 2014, which is incorporated herein by reference in its entirety.

BACKGROUND OF THE INVENTION

Technical Field

The present invention relates to audio equipment and, more particularly, to input and output terminals of the same.

Related Art

Although various types of audio equipment have hitherto been equipped with input terminals and output terminals, each of the terminals requires a footprint. Hence, when miniaturization of portable equipment is sought, the footprints might cause a hindrance to miniaturization.

JP S64-003374 U describes determining whether a terminal connected to a video input/output terminal is an input terminal or an output terminal by detecting a difference between d.c. impedance of the input terminal and d.c. impedance of the output terminal of the video input/output terminal; and automatically switching between the input and the output of the video input/output terminal.

JP H11-239289 A describes standardizing an input terminal of a digital video signal and an output terminal of an analog video signal or standardizing an output terminal of the digital video signal and an output terminal of the analog video signal, thereby integrating the terminals of a still picture imaging device.

JP 2001-086416 A describes realizing a shared use of an external video input terminal and an external video output terminal and a shared use of an external audio input terminal and an external audio output terminal; and automatic or manual switching between the input terminals and the output terminals if the user desires.

However, the related-art techniques provide only standardization of two terminals; namely, the input terminal and the output terminal or the analog terminals and the digital terminals, without attaining standardization of a larger number of terminals.

Particularly in recent years, portable headphone amplifying devices have been developed with a view toward fulfilling users' desires to play music data stored in a smartphone, and others, and listen to music with high quality through headphones. In order to cope with a variety of devices, some headphone amplifying device are often equipped with an analog input terminal, a digital coaxial input terminal, a digital coaxial output terminal, and an optical input terminal as well as a USB connector for connection with a smartphone and an analog output terminal for connection with a headphone. A problem is how to standardize the variety of terminals.

SUMMARY

The present invention provides audio equipment capable of being miniaturized by standardizing a plurality of types of input terminals and output terminals and miniaturizing footprints of the terminals.

Audio equipment of the present invention includes an input/output terminal which shares at least three of a digital audio input terminal, a digital audio output terminal, an analog audio input terminal, and an analog audio output terminal; the analog audio output terminal; a changeover section for switching functions of the input/output terminal; a conversion section for converting a digital audio signal into an analog audio signal; an amplifying section for amplifying the analog audio signal and outputting the analog audio signal to the analog audio output terminal; and a control section which, in response to switching operation of the changeover section, supplies the digital audio signal input from the input/output terminal to the conversion section when the input/output terminal acts as the digital audio input terminal, supplies the analog audio signal input from the input/output terminal to the amplifying section when the input/output terminal acts as the analog audio input terminal, supplies the digital audio signal to the input/output terminal when the input/output terminal acts as the digital audio output terminal, and supplies the analog audio signal to the input/output terminal by way of the conversion section when the input/output terminal acts as the analog audio output terminal.

In one embodiment of the present invention, the audio equipment further includes a storage section for storing the digital audio signal, wherein the control section automatically switches the input/output terminal to the digital audio output terminal when supplying the digital audio signal stored in the storage section to the conversion section.

In another embodiment of the present invention, the input/output terminal acts as at least any of the digital audio optical input terminal and the digital audio coaxial input terminal when acting as the digital audio input terminal, and the input/output terminal acts as at least any of the digital audio optical output terminal and the digital audio coaxial output terminal when acting as the digital audio output terminal.

The present invention is suitable particularly for portable headphone amplifying equipment.

According to the present invention, footprints of terminals can be reduced by shared use of a plurality of types of input terminals and output terminals, thereby enabling miniaturization of the equipment.

The invention will be more clearly comprehended by reference to the embodiments provided below. However, the embodiments provided below are illustrative, and the scope of the invention is not limited to the embodiments.

BRIEF DESCRIPTION OF THE DRAWINGS

Preferred embodiments of the present invention will be described in detail by reference to the following drawings, wherein:

FIG. 8 is a table of switching among functions in the embodiment;

FIG. 11 is a table of switching among functions in the embodiment.

DETAILED DESCRIPTION

By reference to the drawings, embodiments of the present invention are hereunder described by taking portable headphone amplifying equipment with a built-in SD player. The portable headphone amplifying equipment is one which is connected to a portable device, such as a smartphone, and which converts a digital audio signal input from the portable device with a digital-to-analog converter and outputs the converted audio signal from a headphone terminal after amplifying the signal with a high-quality amplifier. The SD player is a device that reproduces a digital audio signal stored in an SD card and outputs the digital audio signal. The equipment of the embodiment is one fulfilling the two functions. However, the following embodiments are illustrative, and the present invention is not limited to the following embodiments.

Figure 1:
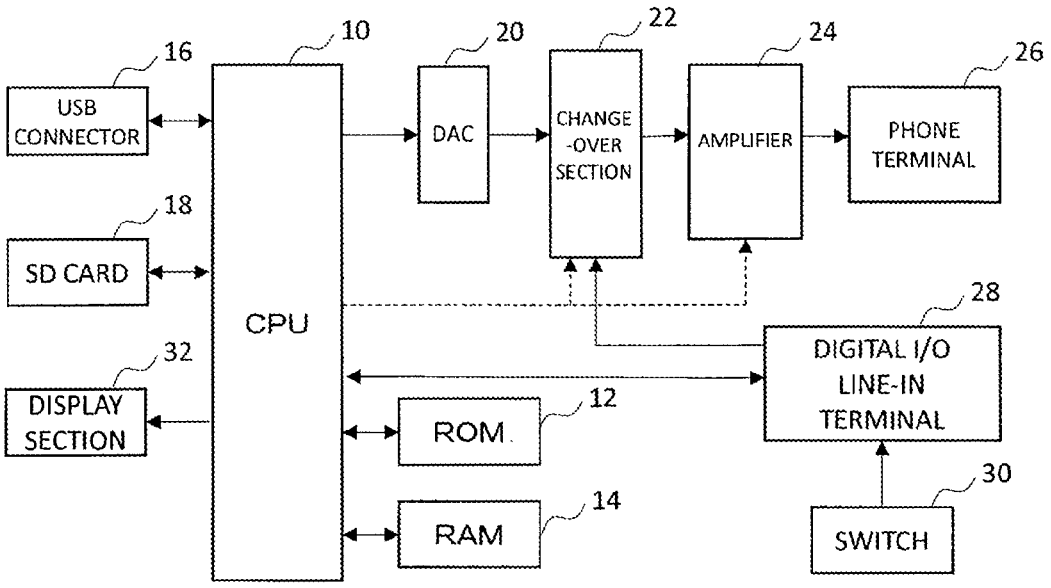
FIG. 1 is a configuration block diagram of an embodiment.

FIG. 1 is a configuration block diagram of the equipment of the present embodiment. The headphone amplifying equipment has a CPU 10, ROM 12, RAM 14, a USB connector 16, an SD card 18, a DAC (D/A converter) 20, a changeover section 22, an amplifier 24, a PHONE (headphone) terminal 26, a DIGITAL I/O LINE-IN terminal 28, a switch 30, and a display section 32.

According to a program stored in the ROM 12, the CPU 10 performs predetermined processing by using the RAM 14 as working memory.

The USB connector 16 is one for connecting a portable device, such as a smartphone, with a personal computer.

The SD card 18 stores digital audio data.

When the portable device, such as a smartphone, is connected to the USB connector 16 and when receiving a digital audio signal, the CPU 10 outputs the digital audio signal to the DAC 20. When an SD player function is selected by means of operation performed on an unillustrated operating section, the CPU 10 reads the digital audio signal stored in the SD card 18, outputting the digital audio signal to the DAC.

The DAC 20 converts the digital audio signal into an analog audio signal by means of processing, outputting the analog audio signal to the changeover section 22. The DAC 20 can also convert a so-called high-resolution sound source of PCM 24 bit/192 kHz, DSD 128, into an analog audio signal.

The changeover section 22 is made up of a plurality of contact points of the changeover section and performs switching as to whether to deliver an output of the DAC 20 to the amplifier 24 or output an audio signal input from the DIGITAL I/O LINE-IN terminal 28 to the amplifier 24. Switching of the changeover section 22 is controlled by a control signal from the CPU 10 (indicated by a broken line in the drawing).

The amplifier 24 amplifies the audio signal output from the changeover section 22, outputting the thus-amplified audio signal to the PHONE (headphone) terminal 26. The amplifier 24 amplifies the audio signal by means of; for instance, a push-pull circuit having a discrete configuration. Incidentally, there can also be adopted a configuration in which a gain of the amplifier 24 may be switched between two stages; namely, a high and a low, by means of a gain changeover section, or the like.

The DIGITAL I/O LINE-IN terminal 28 is one which implements a shared use of DIGITAL INPUT (a digital input), DIGITAL OUTPUT (a digital output), and LINE-IN (ANALOG INPUT). The DIGITAL INPUT further implements a shared use of a digital optical input and a digital coaxial input. Specifically, a terminal 28 of the embodiment integrates four input and output terminals provided below into one terminal: namely, a digital audio optical input,
a digital audio coaxial input,
an analog audio input, and
a digital audio coaxial output.

The switch 30 is a user-operable switch and performs switching as to whether to use the DIGITAL I/O LINE-IN terminal 28 as a DIGITAL I/O terminal or a LINE-IN terminal. The switch 30 is formed as a slide switch provided in a vicinity of; for instance, the DIGITAL I/O LINE-IN terminal 28.

When the switch 30 is switched to a LINE-IN position, the CPU 10 controls the changeover section 22 in response to switching performed by the switch 30, supplying the analog audio signal input from the DIGITAL I/O LINE-IN terminal 28 to the amplifier 24 and outputting the signal from the PHONE terminal 26 after amplifying the signal with the amplifier 24. Moreover, when the switch 30 is switched to a DIGITAL I/O position, the CPU 10 displays a selection menu on the display 32, thereby enabling the user to select either a digital input or a digital output. Selection of the digital input or the digital output may also be set such that the selection can be set as a regular setting in a menu hierarchy. When the user selects the digital input, the CPU 10 inputs the digital optical input signal input or the digital coaxial signal from the DIGITAL I/O LINE-IN terminal 28 in accordance with the selection, supplying the signal to the DAC 20. Moreover, the CPU 10 also controls the changeover section 22 to supply an output of the DAC 20 to the amplifier 24. Incidentally, a discrimination as to whether the input is the digital optical input or the digital coaxial input is performed by use of a difference in impedance characteristic. When the user selects the digital output, the CPU 10 outputs the digital audio signal stored in the SD card 18 to the DIGITAL I/O LINE-IN terminal 28 in response to the selection.

The DIGITAL I/O LINE-IN terminal 28 has a function of the digital input terminal and the function of the analog input terminal. Hence, being connected to another audio equipment having a digital output terminal and another audio equipment not having a digital output terminal, the DIGITAL I/O LINE-IN terminal 28 can output a high-quality audio signal from the PHONE terminal 26.

Figure 2A:
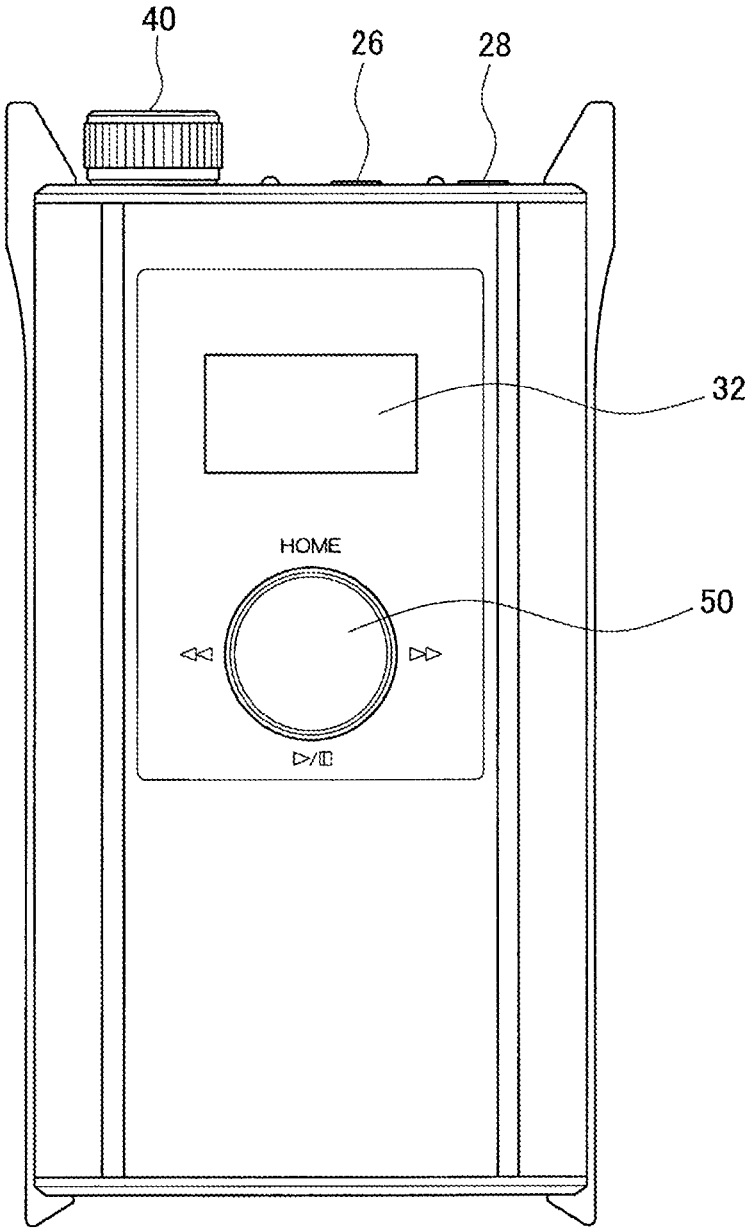
FIG. 2A is a plan view of the embodiment.
Figure 2B:
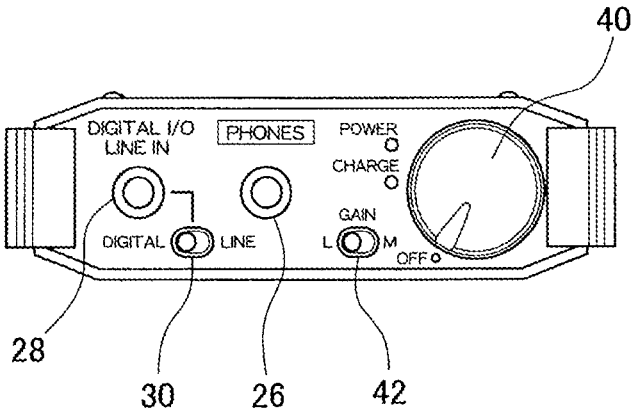
FIG. 2B is a side view of the embodiment.

FIG. 2A and FIG. 2B are a plan view and a side view of the portable headphone amplifying equipment of the present embodiment.

FIG. 2A is a plan view in which an operating section 50 and the display section 32 are placed at predetermined positions. Selection and determination of an operation mode, selection and determination of audio data (music data) to be played back, and selection of a digital input and a digital output of the DIGITAL I/O LINE-IN terminal 28 are performed by means of user's operation of the operating section 50. In addition to various operation information and playback information, a selection menu for selecting the digital input and the digital output of the DIGITAL I/O LINE-IN terminal 28 appears on the display section 32. The PHONE terminal 26, the DIGITAL I/O LINE-IN terminal 28, and a volume knob 40 (also doubles as a power switch) are disposed on one side surface of the equipment.

FIG. 2B is a side view, and the PHONE terminal 26, the DIGITAL I/O LINE-IN terminal 28, and the volume knob 40 are arranged. The switch 30 serving as a slide switch is placed in the vicinity of the DIGITAL I/O LINE-IN terminal 28, and a gain changeover section 42 is placed in the vicinity of the volume knob 40.

"DIGITAL" and "LINE" are marked on left and right ends of the switch 30. The digital input/output and the analog input can be switched by means of the user sliding the switch 30 to the right or the left. As mentioned previously, switching between the digital input and the digital output can be performed in a software manner on the selection menu.

The volume knob 40 is for controlling a level of an audio signal output from the PHONE terminal 26 and doubles as a power switch. In the present embodiment, when the volume knob 40 is situated at the left end, the power switch is in OFF position. The power is turned on by turning the volume knob 40 to the right. The level of the audio signal output from the PHONE terminal 26 according to an amount of turning (turn angle) of the volume knob 40 is adjusted increasingly or decreasingly. Moreover, the gain changeover section 42 is a changeover section for switching the gain of the amplifier 24 in two stages; namely, a high and a low.

As illustrated in the side view of FIG. 2B, the portable headphone amplifying equipment of the present embodiment should originally be equipped with four input and output terminals: namely, a digital audio optical input terminal;

a digital audio coaxial input terminal;

an analog audio input terminal; and a digital audio coaxial output terminal.

However, these switches are embodied by the single DIGITAL I/O LINE-IN terminal 28, and the functions of the switches are switched as required, thereby reducing the footprints of the terminals and enabling miniaturization of the equipment.

FIG. 3 through FIG. 6 are explanatory views showing an audio signal flow contingent to switching among the functions of the DIGITAL I/O LINE-IN terminal 28.

Figure 3:
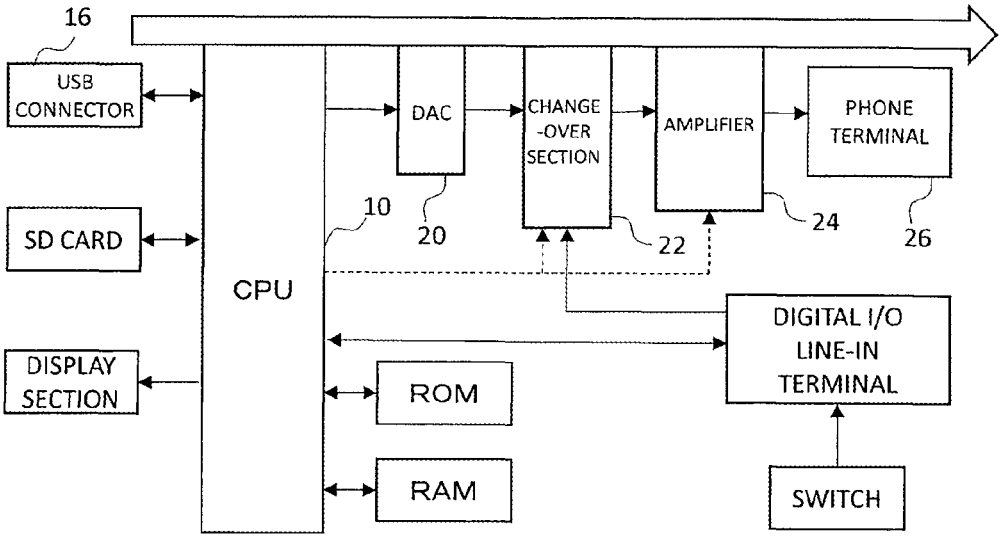
FIG. 3 is an explanatory view showing a flow of an audio signal of the embodiment.

FIG. 3 shows a flow achieved when the equipment operates as the headphone amplifying equipment; namely, when the equipment is connected to a smartphone or a personal computer. The DIGITAL I/O LINE-IN terminal 28 is in an arbitrary state. The USB connector 16 is connected to the smartphone, and the like. A digital audio signal is supplied by way of the USB connector 16. The flow of the audio signal is the USB connector 16→the CPU 10→the DAC 20→the changeover 22→the amplifier 24→the PHONE terminal 26.

Figure 4:
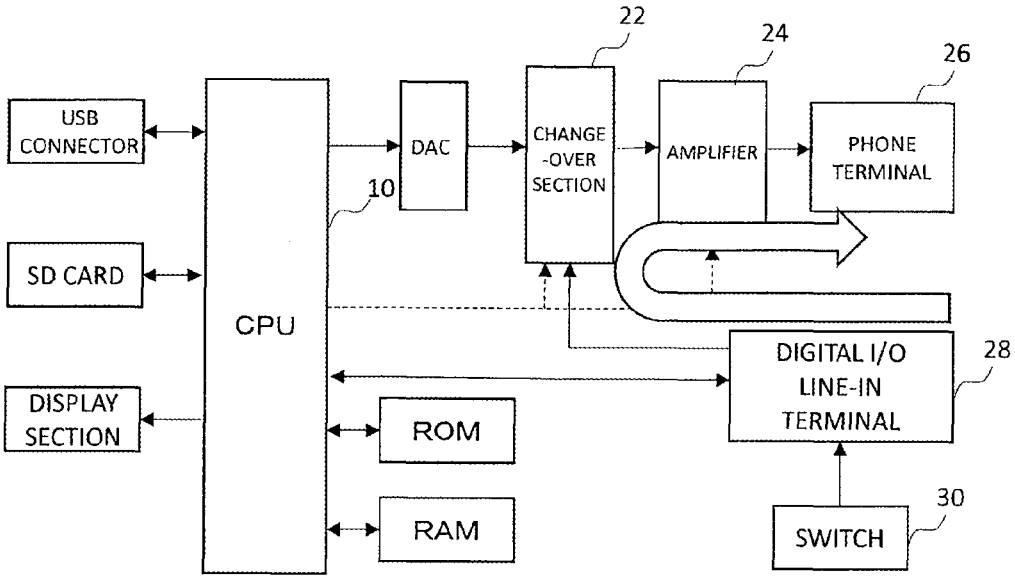
FIG. 4 is an explanatory view showing the flow of the audio signal of the embodiment.

FIG. 4 is a flow achieved when the equipment operates as a headphone amplifying equipment; namely, when the equipment is connected to audio equipment not having the digital output terminal but having the analog output terminal. The DIGITAL I/O LINE-IN terminal 28 is switched to the analog input by means of the switch 30. The flow of the audio signal is the DIGITAL I/O LINE-IN terminal 28→the changeover 22→the amplifier 24→the PHONE terminal 26.

Figure 5:
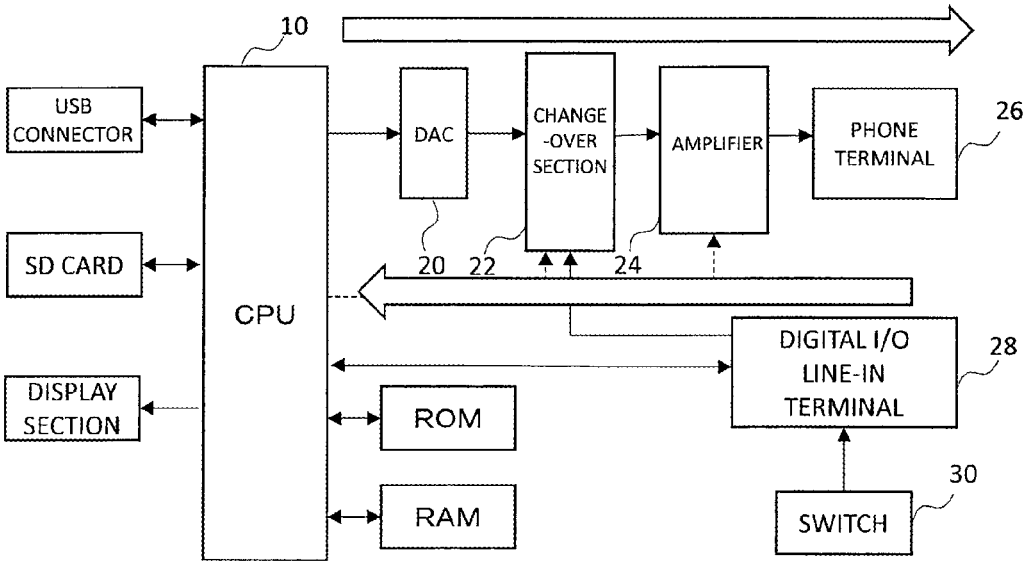
FIG. 5 is an explanatory view showing the flow of the audio signal of the embodiment.

FIG. 5 shows a flow achieved when the equipment operates as a headphone; namely, when the equipment is connected to audio equipment having the digital output terminal. The digital output terminal may also be either an optical output or a coaxial output. The DIGITAL I/O LINE-IN terminal 28 is switched to the digital input by means of the switch 30 and the selection menu. The flow of the audio signal is the DIGITAL I/O LINE-IN terminal 28→the CPU 10→the DAC 20→the changeover 22→the amplifier 24→the PHONE terminal 26.

Figure 6:
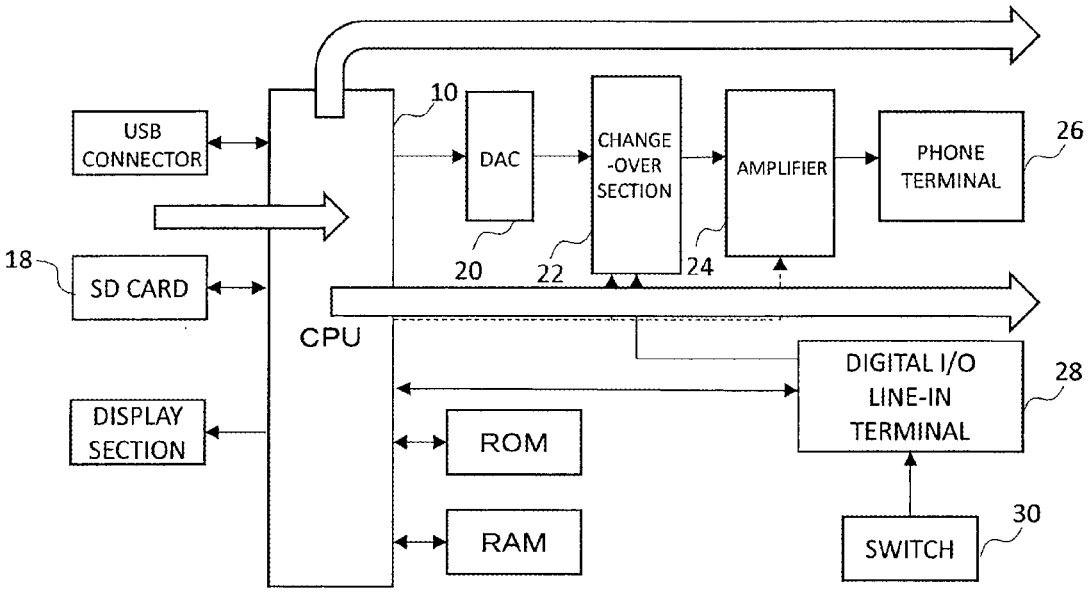
FIG. 6 is an explanatory view showing the flow of the audio signal of the embodiment.

FIG. 6 shows a flow achieved when the equipment operates as an SD player. The DIGITAL I/O LINE-IN terminal 28 is switched to the digital output by means of the switch 30 and the selection menu. The audio data stored in the SD card 18 are read and supplied. The flow of the audio signal is the SD card 18→the CPU 10→the DAC 20→the changeover 22→the amplifier 24→the PHONE terminal 26 and the SD card 18→the CPU 10→the DIGITAL I/O LINE-IN terminal 28.

When the equipment operates the SD player and when the DIGITAL I/O LINE-IN terminal 28 is not set to the digital output, the CPU 10 outputs the audio signal only from the PHONE terminal 26 and may not output the audio signal from the DIGITAL I/O LINE-IN terminal 28.

Figure 7:
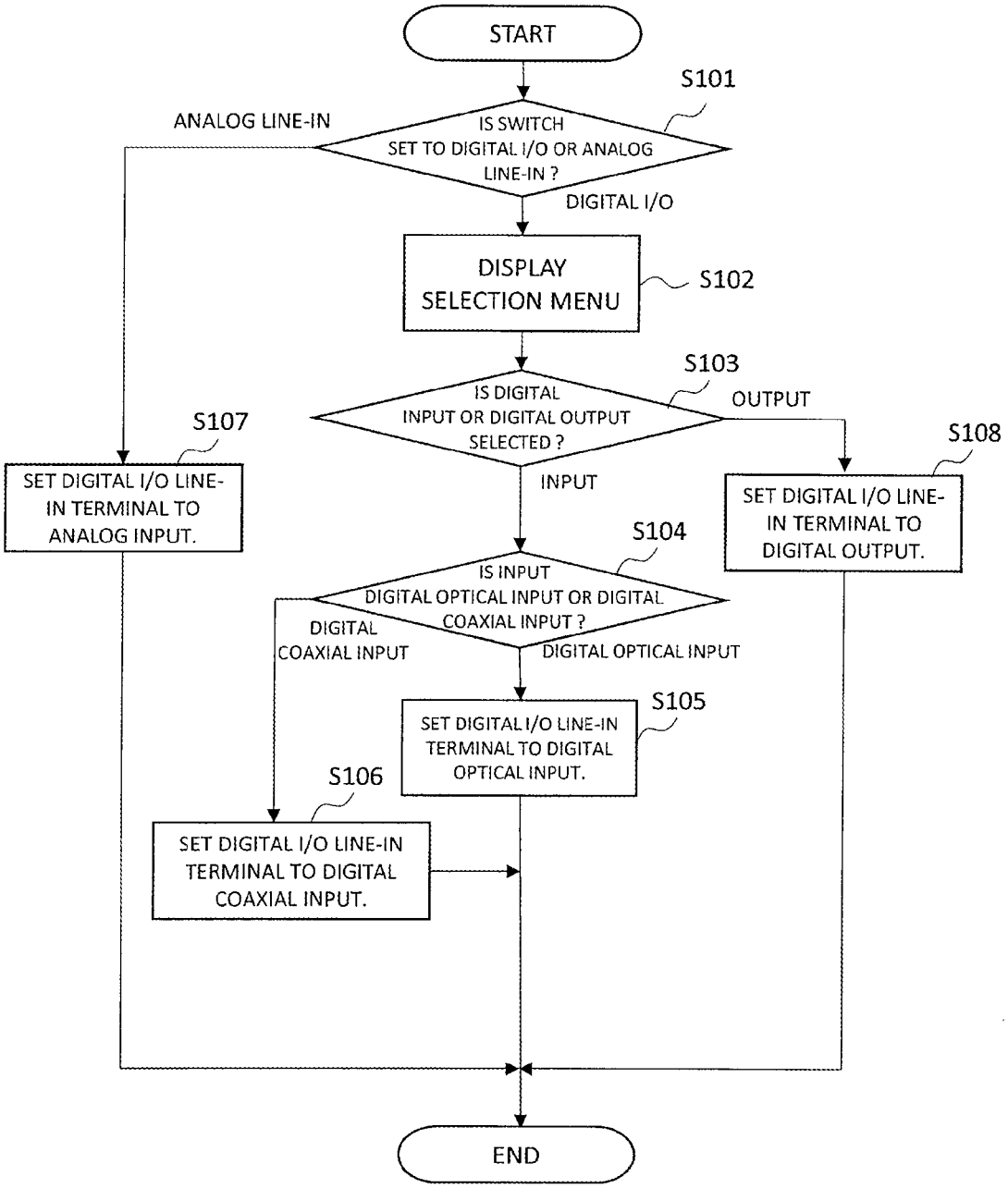
FIG. 7 is a processing flowchart of the embodiment.

FIG. 7 is a processing flowchart of the embodiment.

The CPU 10 determines whether the switch 30 is set to either DIGITAL or LINE (S101). When the switch 30 is set to "LINE," the setting means the analog input. Hence, the CPU 10 sets the DIGITAL I/O LINE-IN terminal 28 to the analog input (S107). Specifically, the CPU 10 supplies the analog audio signal input from the DIGITAL I/O LINE-IN terminal 28 to the changeover 22, controls the contact points of the changeover 22, and supplies the analog audio signal to the amplifier 24. The amplifier 24 amplifies the analog audio signal and outputs the amplified analog audio signal to the PHONE terminal 26. The user connects the headphone to the PHONE terminal, thereby becoming able to perform high-quality listening.

In the meantime, when the switch 30 is set to "DIGITAL," the setting means the digital input/output. Hence, the CPU 10 displays the selection menu on the display section 32 (S102), thereby allowing the user to select either the digital input or the digital output (S103).

When the user selects the output, the CPU 10 sets the DIGITAL I/O LINE-IN terminal 28 to the digital output (S108). Specifically, the CPU 10 reads the digital audio data stored in the SD card 18 and enables the DIGITAL I/O LINE-IN terminal 28 to output the thus-read digital audio data. The function achieved at this time is a digital output function of the SD player. The portable headphone amplifying equipment with a built-in SD player does not act as a digital output of the SD player and a digital/analog input of the headphone amplifying equipment at one time. Therefore, no problem is encountered in causing the DIGITAL I/O LINE-IN terminal 28 to double the input and the output.

When the user selects an input, a determination is then made as to whether the input is a digital optical input or a digital coaxial input (S104). The determination can also be made on the basis of whether or not the optical signal is detected as well as a difference in impedance characteristic. In the case of the digital optical input, the CPU 10 sets the DIGITAL I/O LINE-IN terminal 28 to the digital optical input (S105). In the case of the digital coaxial input, the CPU 10 sets the DIGITAL I/O LINE-IN terminal 28 to the digital coaxial input (S106). In these cases, the digital audio signal input from the DIGITAL I/O LINE-IN terminal 28 is supplied to the CPU 10. The CPU 10 outputs the signals from the PHONE terminal 26 byway of the DAC 20, the changeover 22, and the amplifier 24.

FIG. 8 is summarizing switching among functions of the DIGITAL I/O LINE-IN terminal 28 of the present embodiment as a table. The functions of the DIGITAL I/O LINE-IN terminal 28 are switched by means of the mechanical switch 30 and the software selection menu which serve as a changeover section for switching terminal functions. Hence, the mechanical switch is taken as a hard switch (the switch 30), and the software selection menu is taken as the software selection switch (the selection menu). Switching between a digital input/output (DIGITAL I/O) and the analog switch (Analog Line-In) is performed by means of the hard switch, and switching between the input (Input) and the output (Output) is performed by means of the soft switch. Accordingly, when the digital input/output is switched by the hard switch and when switching to the input is effected by the soft switch, the DIGITAL I/O LINE-IN terminal 28 turns into the digital input (the digital optical input and the digital coaxial input). When switching to the digital input/output is effected by the hard switch and when switching to an output is effected by the soft switch, the DIGITAL I/O LINE-IN terminal 28 turns into the digital output (the digital coaxial output). When switching to the analog input is effected by the hard switch, the DIGITAL I/O LINE-IN terminal 28 turns into the analog input without use of the soft switch (the selection menu is not displayed).

In the present embodiment, there is provided, as an input/output terminal, the DIGITAL I/O LINE-IN terminal 28 that doubles as four terminals; namely, the digital audio optical input, the digital audio coaxial input, the digital audio coaxial output, and the analog audio input. Further, the DIGITAL I/O LINE-IN terminal 28 is also embodied as a DIGITAL I/O LINE I/O TERMINAL that doubles as five terminals which includes an analog audio output in addition to the four terminals.

Figure 9:
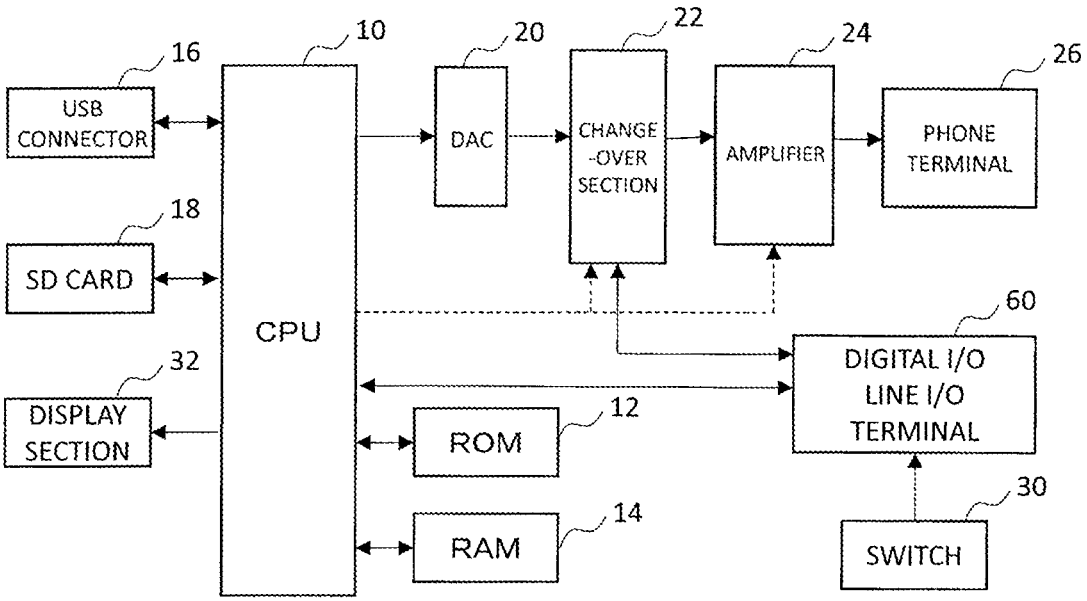
FIG. 9 is a configuration block diagram of another embodiment.

FIG. 9 is a functional block diagram achieved when the DIGITAL I/O LINE-IN terminal 28 is replaced with a DIGITAL I/O LINE I/O TERMINAL 60. Since a basic configuration of the block diagram is the same as that of the embodiment shown in FIG. 1, explanations are given solely to a difference between the embodiment shown in FIG. 1 and the block diagram.

The DIGITAL I/O LINE I/O TERMINAL 60 is a terminal that doubles as a DIGITAL INPUT (a digital input), a DIGITAL OUTPUT (a digital output), a LINE-IN (an analog input), and a LINE-OUT (an analog output). The DIGITAL INPUT further doubles as a digital optical input and a digital coaxial input. Specifically, the terminal 60 of the embodiment is one terminal into which five input and output terminals; that is, the digital audio optical input,
the digital audio coaxial input,
the analog audio input,
the digital audio coaxial output, and
the analog audio output, are integrated.

The switch 30 is a switch for causing the DIGITAL I/O LINE I/O terminal 60 to work as a DIGITAL I/O TERMINAL or a LINE I/O terminal.

When the switch 30 is switched to the LINE I/O, the CPU 10 displays the selection menu on the display section 32, thereby enabling the user to select either the analog input or the analog output. A selection between the analog input and the analog output can also be set as the regular setting on the menu hierarchy. When the user selects the analog input, the CPU 10 controls the changeover section 22, thus supplying the analog audio signal input from the DIGITAL I/O LINE I/O terminal 60 to the amplifier 24, and outputting the analog audio signal from the PHONE terminal after amplifying the signal in the amplifier 24. When the user selects the analog output, the CPU 10 controls the changeover section 22, thus outputting a digital audio signal input from the USB connector 16 or a digital audio signal read from the SD card 18 to output as an analog audio signal from the DIGITAL I/O LINE I/O TERMINAL 60 via the DAC 20 and the changeover section 22. Concurrently, the CPU 10 outputs the analog audio signal from the PHONE terminal via the DAC 20, the changeover section 22, and the amplifier 24. An amplifier for controlling an output level can also be interposed between the changeover section 22 and the DIGITAL I/O LINE I/O terminal 60.

Figure 10:
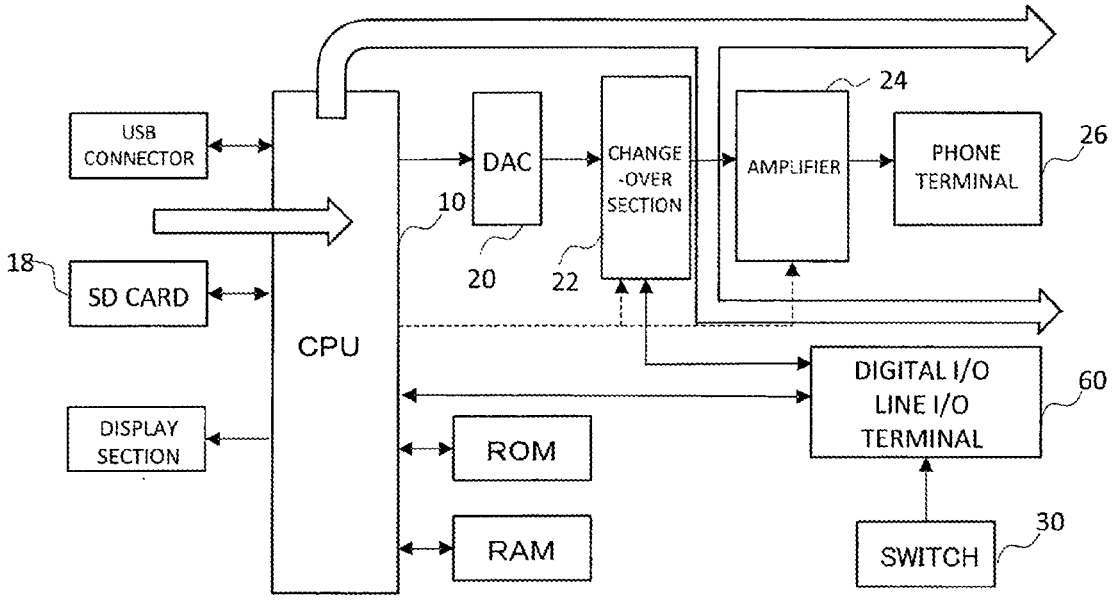
FIG. 10 is an explanatory view showing a flow of an audio signal of the embodiment.

FIG. 10 is a flow achieved when the DIGITAL I/O LINE I/O terminal 60 acts as the analog output terminal. The switch 30 is switched to the LINE I/O and set to the analog output under control of the changeover section 22. Thereby, the digital audio signal from the USB connector 16 or the digital audio signal from the SD card 18 is supplied. Flow of the audio signal is the USB connector 16 or the SD card 18→the CPU 10→the DAC 20→the changeover section 22→the amplifier 24→and the PHONE terminal 26.

Moreover, the flow is the USB connector 16 or the SD card 18→the CPU 10→the DAC 20→the changeover section 22→the DIGITAL I/O LINE I/O terminal 60

FIG. 11 summarizes as a table switching among functions of the DIGITAL I/O LINE I/O terminal 60 of another embodiment is summarized. The functions of the DIGITAL I/O LINE I/O terminal 60 are switched by the mechanical switch 30 and the software selection menu that serve as a changeover section for switching terminal functions. The mechanical switch is taken as a hard switch (the switch), and the software selection menu is taken as a soft switch (the selection menu). The hard switch switches between the digital input/output (DIGITAL I/O) and the analog input/output (LINE I/O). The soft switch switches the input (Input) and the output (Output). Accordingly, when switched to the digital input/output by the hard switch and switched to the input by the soft switch, the DIGITAL I/O LINE I/O terminal 60 turns into the digital input (the digital optical input and the digital coaxial input). When switched to the digital input/output by the hard switch and switched to the output by the soft switch, the DIGITAL I/O LINE I/O terminal 60 is switched to the digital output (the digital coaxial output). When switched to the analog input/output by the hard switch and to the input by the soft switch, the DIGITAL I/O LINE I/O terminal 60 turns into an analog input. When switched to the analog input by the hard switch and to the output by the soft switch, the DIGITAL I/O LINE I/O terminal 60 turns into the analog output.

The embodiment of the present invention has been described thus far, but the present invention is not limited to this and susceptible to various modifications.

For instance, default settings (a default achieved at power ON) are made in advance such that the audio equipment acts as headphone amplifying equipment and that the DIGITAL I/O LINE-IN terminal 28 is set to the input terminal (the digital input terminal and the analog input terminal). When the user selects operation of the SD player by operating the operating section 50, the DIGITAL I/O LINE-IN terminal 28 can also be automatically switched from the input terminal to the output terminal (the digital output terminal) in synchronization with playback operation of the SD player. The reason for this is that, as mentioned previously, an audio signal cannot be input from the outside in the playback mode. As shown in FIG. 6, when the operation of the SD player is selected, the CPU 10 outputs the digital audio signal from the digital output terminal, concurrently outputting the analog audio signal from the PHONE terminal 26 by way of the DAC 20, the changeover section 22, and the amplifier 24. In this case, since the audio signal is output from two output terminals, listening can be shared between two persons. When the audio equipment is operated again as the headphone amplifying equipment of ter having finished operation of the SD player, the essential requirement for the CPU 10 is to set the DIGITAL I/O LINE-IN terminal 28 again to the input terminal. The modification is similarly applicable to an embodiment shown in FIG. 9 and FIG. 10. In the case of the embodiment shown in FIG. 9 and FIG. 10, the DIGITAL I/O LINE I/O terminal 60 outputs an analog signal, and hence a headphone can be connected directly to the DIGITAL I/O LINE I/O terminal 60.

Moreover, in the present embodiment, the changeover section is made up of the hard switch and the soft switch, and the hard switch performs switching between the digital input/output and the analog input, and the soft switch performs switching between the digital input and the digital output. Alternatively, the CPU 10 may detect a connect ion of a plug into the DIGITAL I/O LINE-IN terminal 28 and display on the display section 32 the selection menu for selecting the digital input/output or the analog input, thereby replacing the hard switch with the soft switch. In this case, switching among the functions of the DIGITAL I/O LINE-IN terminal 28 is all implemented by the soft switch. In the embodiment shown in FIG. 9 and FIG. 10, the CPU 10 detects connection of the plug with the DIGITAL I/O LINE I/O terminal 60, displaying on the display section 32 the selection menu for selecting the digital input/output or the analog input/output. Similarly, the hard switch can be replaced with the soft switch.

In the present embodiment, the digital optical input terminal is implemented with regard to the digital optical signal by the DIGITAL I/O LINE-IN terminal 28 or the DIGITAL I/O LINE I/O terminal 60 in connection with the function of the headphone amplifying equipment. However, a digital optical output terminal in lieu of the digital optical input terminal can also be implemented by the DIGITAL I/O LINE-IN terminal 28 or the DIGITAL I/O LINE I/O terminal 60. Specifically, in lieu of the digital optical signal and the digital coaxial signal serving as digital inputs, the digital input can also be embodied by the digital coaxial signal, and the digital output can also be embodied by the digital optical signal and the digital coaxial signal. In the present embodiment, a possible combination of shared uses is illustrated as follows:

(1) the digital audio optical input terminal, the digital audio coaxial input terminal, the digital audio coaxial output terminal, and the analog audio input terminal;

(2) the digital audio optical output terminal, the digital audio coaxial input terminal, the digital audio coaxial output terminal, and the analog audio input terminal;

(3) the digital audio optical input terminal, the digital audio coaxial output terminal, and the analog audio input terminal;

(4) the digital audio coaxial input terminal, the digital audio optical output terminal, and the analog audio input terminal;

(5) the digital audio optical input terminal, the digital audio coaxial output terminal, the analog audio input terminal, and the analog audio output terminal;

(6) the digital audio coaxial input terminal, the digital audio optical output terminal, the analog audio input terminal, and the analog output terminal; and (7) the digital audio optical input terminal, the digital audio coaxial input terminal, the digital audio coaxial output terminal, the analog audio input terminal, and the analog output terminal.

In short, in the present embodiment, at least three of the digital audio input terminal, the digital audio output terminal, the analog audio input terminal, and the analog audio output terminal are shared. Further, the digital audio input terminal can be taken as at least any of the digital audio optical input terminal and the digital audio coaxial input terminal. Further, the digital audio output terminal can be taken as at least any of the digital audio optical output terminal and the digital audio coaxial output terminal.

What is claimed is:

1. Audio equipment comprising:

a plurality of outer side surfaces;

an input/output terminal provided on one of the outer side surfaces and sharing at least three of a digital audio input terminal, a digital audio output terminal, an analog audio input terminal, and a first analog audio output terminal, wherein the at least three of the digital audio input terminal, the digital audio output terminal, the analog audio input terminal, and the first analog audio output terminal are accessible from outside of the audio equipment through the input/output terminal;

a second analog audio output terminal provided on one of the outer side surfaces;

a changeover switch that includes a plurality of contact points, wherein the changeover switch, in operation, changes functions of the input/output terminal among the at least three of the digital audio input terminal, the digital audio output terminal, the analog audio input terminal, and the first analog audio output terminal by changing one or more connections between two or more of the contact points;

a digital-to-analog converter which, in operation, converts a digital audio signal into an analog audio signal;

an amplifier which, in operation, amplifies the analog audio signal and outputs the analog audio signal to at least one of the first analog audio output terminal and the second analog audio output terminal; and a processor which, in operation, in response to a switching operation of the changeover switch, supplies the digital audio signal input from the input/output terminal to the digital-to-analog converter when the changeover switch causes the input/output terminal to function as the digital audio input terminal, supplies the analog audio signal input from the input/output terminal to the amplifier when the changeover switch causes the input/output terminal to function as the analog audio input terminal, supplies the digital audio signal to the input/output terminal when the changeover switch causes the input/output terminal to function as the digital audio output terminal, and supplies the analog audio signal to the input/output terminal by way of the digital-to-analog converter when the changeover switch causes the input/output terminal to function as the first analog audio output terminal.

2. The audio equipment according to claim 1, further comprising a memory that stores the digital audio signal, wherein the processor, in operation, automatically causes the input/output terminal to function as the digital audio output terminal when supplying the digital audio signal stored in the memory to the digital-to-analog converter.

3. The audio equipment according to claim 1, wherein the input/output terminal functions as a digital audio optical input terminal or a digital audio coaxial input terminal when the changeover switch causes the input/output terminal to function as the digital audio input terminal, and the input/output terminal functions as a digital audio optical output terminal or a digital audio coaxial output terminal when the changeover switch causes the input/output terminal to function as the digital audio output terminal.

4. The audio equipment according to claim 1, wherein the audio equipment is portable headphone amplifying equipment.

* * * * *